US005254233A

United States Patent [19]

Nakao et al.

[11] Patent Number: 5,254,233

[45] Date of Patent: Oct. 19, 1993

[54] MONOPOLAR ION EXCHANGE MEMBRANE ELECTROLYTIC CELL ASSEMBLY

[75] Inventors: Makoto Nakao, Yokohama; Hidenori Shibata, Chiba; Takeo Aikawa, Kimitsu; Takahiro Uchibori, Funabashi; Hiroki Yano, Ichihara, all of Japan

[73] Assignee: Asahi Glass Company Ltd., Tokyo, Japan

[21] Appl. No.: 911,737

[22] Filed: Jul. 10, 1992

Related U.S. Application Data

[63] Continuation of Ser. No. 654,060, Feb. 12, 1991, Pat. No. 5,221,452.

[30] Foreign Application Priority Data

Feb. 15, 1990 [JP] Japan ..... 2-32497
Sep. 21, 1990 [JP] Japan ..... 2-250303

[51] Int. Cl.[5] ..... C25B 9/00; C25B 11/03; C25B 11/04; C25B 13/04

[52] U.S. Cl. ..... 204/257; 204/258; 204/263; 204/266; 204/279; 204/284; 204/283; 204/290 F; 204/292; 204/293; 204/296

[58] Field of Search ..... 204/252-258, 204/263-266, 283-284, 290 R, 290 F, 279

[56] References Cited

U.S. PATENT DOCUMENTS

| | | | |
|---|---|---|---|
| 4,210,516 | 7/1980 | Mose et al. | 204/284 |
| 4,439,297 | 3/1984 | Kircher et al. | 204/283 X |
| 4,464,242 | 8/1984 | Boulton | 204/284 X |
| 4,502,935 | 3/1985 | Lohrberg et al. | 204/258 X |
| 4,560,461 | 12/1985 | Okazaki et al. | 204/252 |
| 4,592,822 | 6/1986 | de Nova | 204/283 X |
| 4,605,482 | 8/1986 | Shiragami et al. | 204/258 |
| 4,734,181 | 3/1988 | Cipriano | 204/257 |
| 4,738,763 | 4/1988 | Abrahamson et al. | 204/283 X |
| 4,746,415 | 5/1988 | Boulton et al. | 204/284 X |
| 4,839,013 | 6/1989 | Lohrberg et al. | 204/283 X |
| 4,923,582 | 5/1990 | Abrahamson et al. | 204/257 X |
| 4,936,972 | 6/1990 | Lohberg | 204/283 X |
| 5,082,543 | 1/1992 | Gnann et al. | 204/283 X |
| 5,112,463 | 5/1992 | Zhang et al. | 204/256 X |

FOREIGN PATENT DOCUMENTS

| | | |
|---|---|---|
| 0039046 | 11/1981 | European Pat. Off. . |
| 0064608 | 11/1982 | European Pat. Off. . |
| 2433592 | 7/1979 | France . |

OTHER PUBLICATIONS

Patent Abstracts of Japan, vol. 6, No. 197 (C-128) (1075), Oct. 6, 1982; & JP-A-57 108 279 (Asahi Glass K.K.) Jul. 6, 1982.

Patent Abstracts of Japan, vol. 8, No. 114 (C-225) (1551), May 26, 1984; & JP-A-59 28 583 (Toyo Soda Kogyo K.K.) Feb. 15, 1984.

*Primary Examiner*—Donald R. Valentine

*Attorney, Agent, or Firm*—Oblon, Spivak, McClelland, Maier & Neustadt

[57] ABSTRACT

A monopolar ion exchange membrane electrolytic cell assembly comprising a plurality of unit electrolytic cells connected electritically in parallel to one another, each formed by clamping an anode compartment frame and a cathode compartment frame with an ion exchange membrane interposed therebetween, the anode and cathode compartment frames each having a feeding and discharging system for an electrolyte and a discharging system for generated gas, wherein:

(a) an anode is made of a foraminous plate fixed to the anode compartment frame so that it is close to or in contact with the ion exchange membrane, and electricity is supplied to the foraminous plate via power supply rods and/or power supply ribs from a power source located outside the cell, (b) a cathode is made of flexible foraminous metal plate having good conductivity with an electric resistance at 20° C. of not higher than 10 $\mu\Omega$.cm so that the cathode itself has a current collecting function, and one peripheral end thereof is extended outward from the cell to conduct the electricity to the exterior of the cell, and, preferably, (c) the flexible foraminous cathode plate is pressed by a resilient member from the side opposite to the side facing the ion exchange membrane, whereby the flexible cathode plate is deflected so that the cathode is close to or in contact with the ion exchange membrane.

20 Claims, 3 Drawing Sheets

FIGURE 2
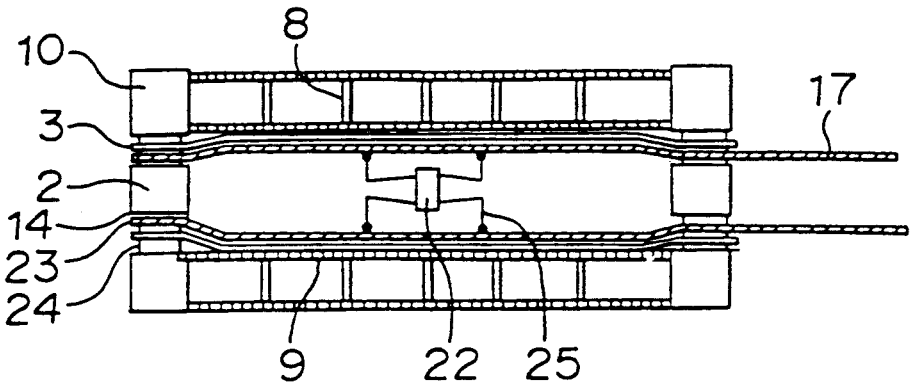
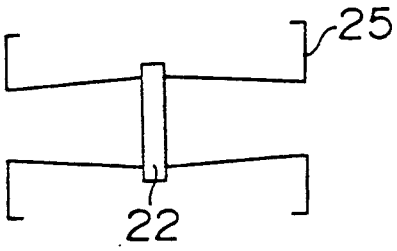
FIGURE 3
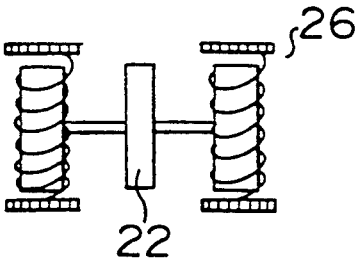
FIGURE 4

MONOPOLAR ION EXCHANGE MEMBRANE ELECTROLYTIC CELL ASSEMBLY

This is a continuation of application Ser. No. 07/654,060, filed on Feb. 12, 1991.

BACKGROUND OF THE INVENTION

Field of the Invention

The present invention relates to a monopolar type ion exchange membrane electrolytic cell assembly.

Various types of electrolytic cells have been proposed as electrolytic cells for producing chlorine and alkali metal hydroxides wherein ion exchange membranes are used as diaphragms. In many cases, a filter press type electrolytic cell assembly is used in which a plurality of rectangular frames (compartment frames) are assembled and clamped.

Types of the electrolytic cells are generally classified based on the difference in the manner of electrical connection into bipolar electrolytic cells of series connection type and monopolar electrolytic cells of parallel connection type. The monopolar type electrolytic cells with which the present invention is concerned, have merits such that control of the current capacity is simple and conversion from a mercury method or an asbestos diaphragm method is easy. Accordingly, a number of monopolar type electrolytic cells have been practically developed.

Generally, an ion exchange membrane electrolytic cell is required to have a function of supplying sufficient electricity (electric current) to the anode and cathode and a necessary amount of electrolytes to conduct the electrode reaction certainly and, at the same time, allowing the ion exchange membranes to perform their own function to minimize the power consumption for electrolysis without damaging the ion exchange membranes. Accordingly, with respect to the construction of a monopolar type electrolytic cell, the method for supplying electricity to the cell and determination of the size of the electrolyzing area and the distance between the electrodes, etc. become important design factors.

With respect to the method for supplying electricity and the size of the electrolyzing area, the method for supplying electricity usually tends to be complicated as the size of the electrolyzing area is enlarged.

Namely, the single plate type monopolar cell disclosed in Japanese Unexamined Patent Publication No. 67879/1983 or Japanese Examined Patent Publication No. 39238/1987, has a simple structure, since the electrode plate itself serves as a power supply member and there is no other power supply means. However, such a structure can hardly be applied to a large scale electrolytic cell, since the loss due to resistance of the electrode plate increases as the electrolyzing area increases. Further, with a monopolar cell of the type reinforced by ribs, wherein electrodes are fixed to the ribs and/or the rods it is possible to freely adjust the electrolyzing area by arranging suitable power supply rods and/or power supply ribs, as shown in Japanese Examined Patent Publication No. 10956/1982 or Japanese Unexamined Patent Publication No. 210980/1982. However, in this case, it is essential to use power supply rods and/or ribs, and the structure is complex. Further, there was a substantial voltage loss accompanying the power supply through the ribs and/or the rods.

Reduction of the distance between electrodes, as an object of the present invention, is an important factor of the cell structure. The purpose of reducing the distance between the electrodes is to lower the voltage for an electrolysis. Namely, as the distance between the electrodes increases, the current path from the anode to the cathode increases, whereby the voltage loss resulting from the passage of current in the electrolyte will increase. Further, in the vicinity of electrodes, gas bubbles will be formed by the electrolysis, and such bubbles tend to increase the substantial electric resistance of the electrolyte, whereby the voltage loss will be further increased.

As another adverse effect of such bubbles, it is also known that the bubbles adhere to the surface of ion exchange membranes to shut out the current path whereby the cell voltage will be increased.

With respect to the adhesion of such bubbles to the membranes, it has been proposed to solve the problem by a method for preventing the adhesion of bubbles by bonding hydrophilic inorganic particles to the membrane surface, as shown in Japanese Examined Patent Publication No. 59185/1987.

It should ideally be possible to shorten the distance between the electrodes by preparing the anode and the cathode perfectly flat and putting them together with a membrane interposed therebetween. However, it is practically unavoidable that some irregularities or distortions are formed during the preparation of the electrode.

However, with respect to a single plate type monopolar cell having an electrolyzing area (portion) with a small width, reduction of the distance between the electrodes has been realized by putting together anode and cathode plates flattened under high dimensional precision with an ion exchange membrane interposed therebetween and clamping them by placing a thin gasket along the periphery of the electrolyzing area, as shown in Japanese Examined Patent Publication No. 37878/1985.

On the other hand, a complicated structure is required for a large size monopolar cell wherein electrodes are reinforced by ribs. As mentioned above, with a large size monopolar cell, it is practically impossible to finish the electrode surface to be completely flat, since various mechanical processings are required, and if the anode surface and the cathode surface are simply put together, there will be a portion where the electrodes abut strongly each other through the membranes, while there will be a portion where the distance between the electrodes is substantially enlarged. As a method for bringing the anode and the cathode in close contact with each other through the membranes while absorbing such a dimensional difference caused by such a lack in the precision for the preparation, it is known to support a flexible cathode or anode by a conductive spring member and to bring the flexible electrode in close contact with the facing electrode by means of the resiliency of the spring, as shown in Japanese Examined Patent Publication No. 3236/1987, or to deform flexible anode and cathode by means of conductive ribs arranged alternately to bring them in contact to each other, as shown in Japanese Examined Patent Publication No. 9192/1987.

Further, as disclosed in Japanese Examined Patent Publication No. 53272/1988 or Japanese Unexamined Patent Publication No. 163101/1983, a method is known wherein a resilient wire mat is provided between an ion exchange membrane and a flexible cathode, so that the cathode is brought in contact with the anode while ensuring the electric connection by the contact of the wire mat. Further, as disclosed in Japanese Unexamined Patent Publications No. 55006/1983 and No 55007/1983, a method is known wherein a current distributing member is divided into two sections and an electrode structure constituting an electrode is bent outwardly so that the electrode is brought in close contact with an ion exchange membrane by the restoring force of the electrode structure.

In these methods except for the case of the first mentioned single plate monopolar cell, a certain resilient member is required to press the electrode in order to bring the electrode in contact with a membrane, and the resilient member is required to have an electrically conductive function at the same time, whereby there has been the following problem. The resilient member is designed to be electrically connected with the electrode by a method such as bonding or contacting, but in order to impart an adequate conductive function, a resilient member having a large cross-sectional area for passage of the electric current or a pressing mechanism having a large contact area with a power supply member, is required. Consequently, a large pressure will be exerted to the pressing electrode.

The ion exchange membrane used as a diagram is a thin plastic film and is likely to be damaged when pressed with such a strong force from an electrode as mentioned above.

Also from the viewpoint of the preparation of an electrolytic cell, with respect to a large size electrolytic cell having a large current capacity and a large electrolytic area, a complicated system is required to accomplish uniform current supply and uniform pressing pressure simultaneously, and thus the preparation of such electrolytic cell has been difficult.

It is an object of the present invention to overcome the complexity of the conventional anode compartment assembly and cathode compartment assembly in a large size monopolar cell and, further to easily reduce the distance between the electrodes to bring the anode and the cathode close to or in contact with each other through the membrane without damaging the membrane.

Reduction of the distance between electrodes is an object of the present invention and an important factor of the cell structure. The purpose of reducing the distance between the electrodes is to lower the voltage for electrolysis. Namely, as the distance between the electrodes increases, the current path from the anode to the cathode increases, whereby the voltage loss resulting from passage of current in the electrolyte will increase.

The present invention provides a monopolar ion exchange membrane electrolytic cell assembly comprising a plurality of unit electrolytic cells connected electritically in parallel to one another, each formed by clamping an anode compartment frame and a cathode compartment frame with an ion exchange membrane interposed therebetween, the anode and cathode compartment frames each having a feeding and discharging system for an electrolyte and a discharging system for generated gas, wherein:

(a) an anode is made of a foraminous plate fixed to the anode compartment frame so that it is close to or in contact with the ion exchange membrane, and electricity is supplied to the foraminous plate via power supply rods and/or power supply ribs from a power source located outside the cell, (b) a cathode is made of flexible foraminous metal plate having good conductivity with an electric resistance at 20° C. of not higher than 10 $\mu\Omega$.cm so that the cathode itself has a current collecting function, and one peripheral end thereof is extended outward from the cell to conduct the electricity to the exterior of the cell, and, preferably, (c) the flexible foraminous cathode plate is pressed by a resilient member from the side opposite to the side facing the ion exchange membrane, whereby the flexible cathode plate is deformed so that the cathode is close to or in contact with the ion exchange membrane.

Now, the present invention will be described in detail with reference to the preferred embodiments.

In the accompanying drawings:

FIG. 2 is a partially cross-sectional view of the electrolytic cell of the same embodiment of the present invention after being assembled.

FIGS. 3 and 4 illustrate respectively the shapes of leaf springs and coil springs as specific examples of the resilient member to be used for the electrolytic cell of the present invention.

Figure 1:
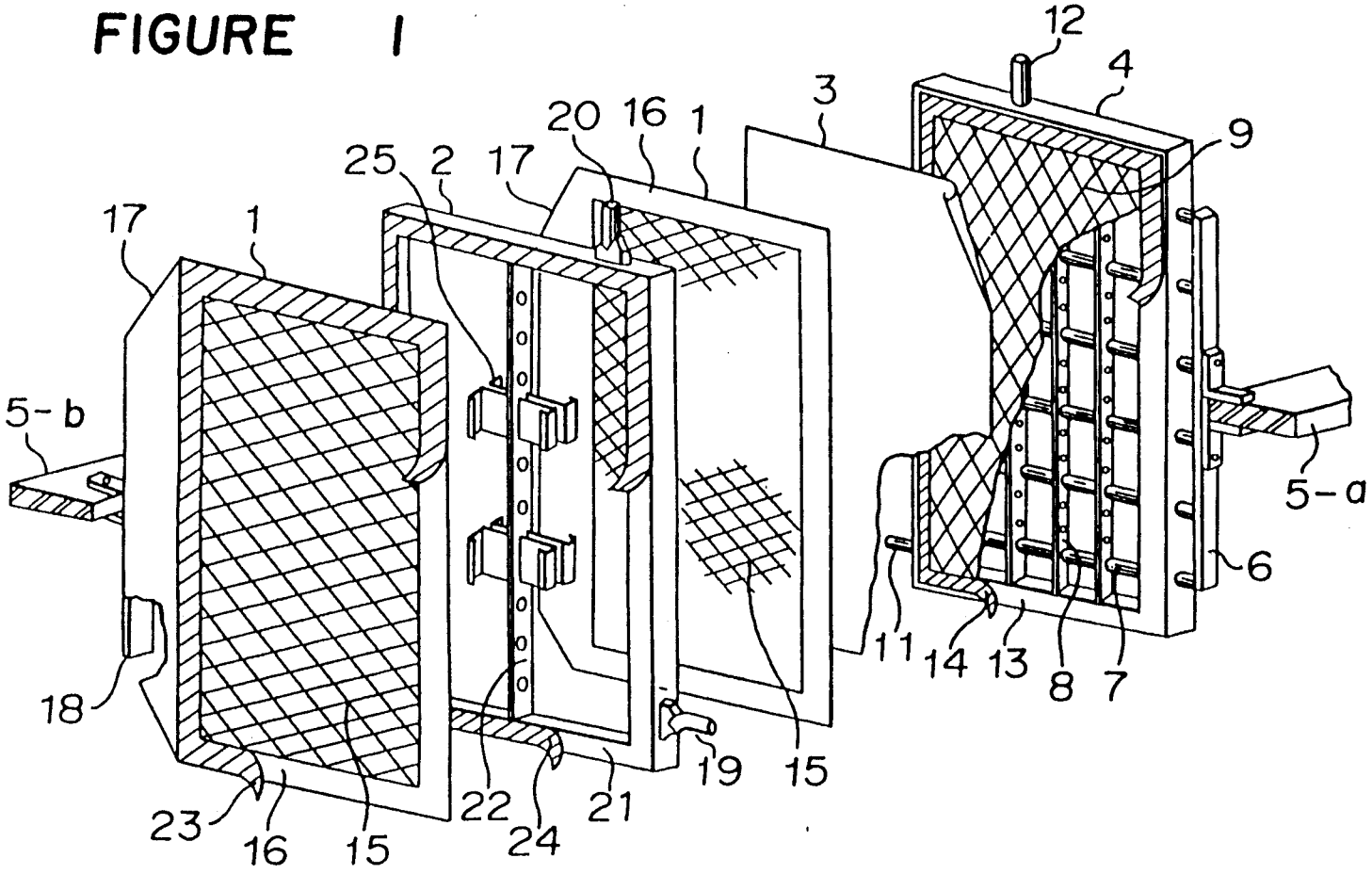
FIG. 1 is a view illustrating a construction of an electrolytic cell as a typical embodiment of the present invention.

In the drawings, reference numeral 1 indicates a cathode plate, numeral 2 indicates a cathode compartment frame, numeral 3 indicates a cation exchange membrane, numeral 4 indicates an anode compartment frame, numeral 7 indicates a power supply rod, numeral 8 indicates a power supply rib, numeral 9 indicates an anode active area, numeral 14 indicates a gasket, numeral 15 indicates a cathode active area, numeral 17 indicates a cathode current collector, numeral 22 indicates a cathode supporting member, numeral 23 indicates a gasket, numeral 24 indicates a gasket, numeral 25 indicates a leaf spring, and numeral 26 indicates a coil spring.

The cathode to be used in the present invention has an electrolyzing portion made of flexible metal of a foraminous sheet-shape having good conductivity, and utilizing the function of good conductivity of the flat plate, it is possible to supply electricity directly to the area for electrode reaction from a power source located outside the cell, whereby it can eliminate a power supply means such as ribs and/or rods which used to be required in a conventional large capacity monopolar cell. Accordingly, with such a cathode plate, its electrolyzing portion may take a non-fixed structure, although its peripheral portion excluding the electrolyzing surface will be fixed, and when, preferably, pressed from behind against the anode, the flexible cathode deforms and approaches the anode at the electrolyzing area.

Further, when the resilient member is used for pressing the cathode, it is not necessarily required to have a conducting function to the electrode plate, although it may be made of a conducting material and the pressing pressure may be small so long as it is capable deflecting the electrode plate, whereby a pressing pressure not to damage the membrane can be selected for pressing the cathode towards the anode. And, by properly disposing the resilient member at the electrolyzing of the cathode, it is possible to certainly bring the cathode in contact or close to the membrane at a distance of less than 2.0 mm, over the entire electrolyzing surface of the electrode, even if the degree of flatness of the electrode surface varies depending upon the location.

The present inventors have studied the influence of the pressing force by conducting electrolysis for a long period of time under such a condition that a membrane and electrodes are in close or in contact to each other, whereby it has been found that the pressing pressure not to damage the membrane is not higher than 500 g/cm$^2$, preferably not higher than 100 g/cm$^2$, of the apparent electrode surface area. As a spring member to provide such a weak pressing pressure, a leaf spring or a coil spring is suitable.

In the FIG. 1 showing a typical Example of the present invention, the electrolyzing area of the electrolytic cell is a vertically elongated shape with a height of from 0.5 to 2.0 m (1.5 m in the Example) and a width of from 0.7 to 1.5 m (1.0 m in the Example), and electric current is supplied from one side to the other side. Electric current flows from an external power source 5-a via the anode compartment frame, the ion exchange membrane and the cathode to an external power source 5-b. At the anode side, the current flows from the external power source firstly to a current distributor 6 and then supplied via power supply rods 7 connected thereto to power supply ribs 8. Then, after uniformly distributed by the power supply ribs, it is supplied to an anode active area 9. Then, from the anolyte via the ion exchange membrane, it passes through the catholyte and flows into a cathode active area 15 having an electrode activity. At the cathode active area, simultaneously with the electrolytic reaction, the electrode itself serves as a conductor and conducts the current in a direction opposite to the anode side power supply end. The current reached the side end of the cathode active area, passes through a cathode plate current collector 17 and flows into an external power source 5-b via a current distributor 18. The anode active surface and the cathode active surface facing each other with a cation exchange membrane interposed therebetween, are disposed to be close at a distance of less than 4.0 mm, preferably 2.0 mm or in contact with each other.

The power supply rods to be used at the anode side are preferably ones having titanium coated on the surface of a core material of copper. A plurality of such power supply rods are attached horizontally to the current distributor, and from there, they extend through the anode compartment frame 4 to the side end of the electrolyzing area.

At the electrolyzing area, the power supply rods intersect with a plurality of power supply ribs 8, and the intersections are welded for electrical connection. The power supply ribs are made of titanium plates having a thickness of from 2 to 6 mm (5 mm in the Example). The anode 9 which may have flexibility as the case requires, is attached to the ribs preferably by welding. The power supply ribs are required to be spaced from each other with a suitable distance to provide both functions of uniformly supplying electric current to the anode and firmly supporting the anode, and the distance is preferably set within range of from 10 to 20 cm (15 cm in the Example). Further, in order to ensure the communication of the electrolyte between adjacent compartments partitioned by the ribs, a plurality of perforations preferably having a diameter of from 5 to 20 mm (10 mm in the Example) are provided. The anode having an electrode activity is preferably the one having a noble metal, preferably, composed mainly of ruthenium coated on a substrate made of valve metal, preferably titanium. The open mesh of the anode is not limited to such an expanded metal, and a punched metal of circular, triangular or tetragonal open mesh, or a louver shape, may also be employed.

The anode compartment frame 4 accommodating the anode and the current supply means, is preferably made of a titanium angular hollow pipe having a square cross section with each side being from 2 to 6 cm (4 cm in the Example). It is provided with an inlet nozzle 11 for supplying an aqueous alkali metal chloride feed solution and an outlet nozzle 12 for discharging chlorine and a dilute brine. The portion facing the membrane of the anode compartment frame is a flat surface 13 formed by the angular pipe. A gasket 14 made preferably of EPDM rubber is disposed on the flat surface 13 to establish liquid sealing with the membrane. Reference numeral 3 indicates a fluorine-containing ion exchange membrane partitioning the anode compartment and the cathode compartment. There is no particular restriction as to the type of the membrane. However, it is preferred to select a membrane which is capable of providing high electrolyzing performance. In the Example, a perfluoro-carbon polymer ion exchange membrane having carboxylic acid groups and/or sulfonic acid groups as ion exchange groups (Flemion 795, manufactured by Asahi Glass Company Ltd.) is employed, whereby high current efficiency is obtainable, and since hydrophilic porous layer is bonded to the membrane surface, a low cell voltage can be obtained.

Now, the foraminous flexible cathode will be described. The center portion of the cathode plate 1 is punched to have rhombic openings and coated with a cathode active substance. The periphery of the cathode plate is a frame-like non foraminous flat portion 16. On both sides i.e. the front and rear sides of the flat portion, liquid sealing is established by mean of gaskets 23 and 24. The openings of the cathode plate may not be restricted to be rhombic by punched out and may be circular, triangular, tetragonal, hexagonal, oval, etc. by various means such as expanding of metals. The opening rate of the cathode active portion 15 is not particularly restricted. However, it is required to minimize a loss due to electric resistance when electric current passes through the electrode plate and to smoothly release hydrogen gas generated at the electrode to the rear side of the electrode. For this purpose, the opening rate is preferably within a range of from 5 to 60% (30% in the Example). With the cathode plate of the present invention, it is unnecessary to employ auxiliary means for power supply such as power supply rods or power supply ribs which are commonly employed, for supplying electric current to the cathode active surface, and the cathode plate itself serves as a power supply means. Accordingly, with respect to the material for the cathode, it is necessary to choose a material which has a minimum loss due to electric resistance and which has corrosion resistance under the electrolyzing condition. Thus, a metal having good conductivity with an electric resistance (specific resistance) at 20° C. of not higher than 10 $\mu\Omega$.cm, preferably no higher than 7 $\mu\Omega$.cm, more preferably not higher than 3 $\mu\Omega$.cm, such as mild steel, nickel, copper, zinc or an alloy such as brass, Parmendur or phosphor bronze, is preferred. Among them, copper is most preferred, since its specific resistance is 1.7 $\mu\Omega$.cm. In the Example, this copper was employed. If the plate thickness is properly set by using such a metal having good conductivity, it is possible to take a long path in the direction of the current, whereby the electrolyzing area can be increased, and it is possible to enlarge the maximum length in the direction of the current at least 70 cm, preferably from 70 to 150 cm (100 cm in the Example), which used to be difficult with conventional monopolar electrolytic cells. The plate thickness is preferably selected taking flexibility and electro-conductive loss due to electric resistance of the material into consideration. In the case of a copper as a cathode material, the thickness is preferably within a range of from 0.5 to 3 mm (2 mm in the Example). Many of such highly conductive materials do not necessarily show adequate elecrochemical stability against an alkali metal hydroxide. Therefore, to employ such materials as cathodes, it is preferred or necessary in many cases to conduct treatment for coating the surface of the base materials with a corrosion resistant layer. Thus, a corrosion resistant protective layer is usually provided preferably by nickel plating on the cathode active surface and on the sealing portion 16 around it, which will be in contact with the catholyte. For the nickel plating, either electroplating or chemical plating may be employed. In the present example, electroplating using a nickel chloride bath was adopted. With respect to the thickness of plating, a thickness of from 50 to 200 μm (100 μm in the Example) is selected to secure adequate corrosion resistance.

The cathode active portion was obtained by coating a cathode active substance on the above mentioned foraminous base plate provided with nickel plating. As the cathode active substance, a powder composed mainly of Raney nickel was employed. During the electrolysis, an aluminum component elute from Raney nickel, whereby porous nickel is formed to provide higher cathode activities. It is also possible to employ a material prepared by adding to Raney nickel e.g. a noble metal as a third component. The material for the cathode active substance is not limited to Raney nickel, and it is possible to employ a powdery metal composed mainly of nickel or aluminum and containing rare earth elements, titanium, etc. which has a hydrogen absorbing function. As the coating method, it is possible to employ a dispersion electroplating method as disclosed in Example 1 of Japanese Unexamined Patent Publication No. 112785/1979. The cathode active substance and its coating method are not limited to the above mentioned specific examples. Conventional techniques such as a method of coating e.g. nickel or chromium by flame spraying as disclosed in Japanese Unexamined Patent Publication No. 100279/1984, or methods as disclosed in Japanese Unexamined Patent Publications No. 207183/1982 and No. 47885/1982 may be employed.

The cathode compartment frame 2 is a rectangular frame having an inlet nozzle 19 for supplying a catholyte and an outlet nozzle 20 for discharging hydrogen gas and the formed alkali metal hydroxide solution. As its material, a metal or resin durable against a highly concentrated high temperature alkali metal hydroxide is used. In the present Example, nickel was used, but the material is not limited to nickel. As the metal, nickel, stainless steel having a high nickel content, mild steel provided with nickel plating or stainless steel may be employed. As the resin, it is possible to use EPDM rubber, a hard rubber, a fluorine rubber, polypropylene or heat resistant polyvinyl chloride, which may be used alone or as reinforced by fibers such as carbon fibers of glass fibers. Further, it is possible to employ a material prepared by lining preferably EPDM rubber, an epoxy resin or a fluorine resin on a core material made of e.g. iron or iron alloy. The portion 21 of the cathode compartment frame is made flat and has substantially the same size as the sealing portion of the cathode plate. An EPDM gasket is provided along the circumference 21 to establish liquid sealing between the cathode compartment frame and the cathode plate.

In the preferable case on the rear side of the cathode active portion, at least one electrode supporting member 22 is provided, to which four resilient members, leaf springs 25, are attached. A part or whole of the resilient member may be made of non electro conductive material. The part of the resilient member contacting the cathode can be preferably made of non-conductive material such as a resin, a rubber, etc.

The leaf springs are provided to reduce the distance between the anode and cathode and serve to press the cathode from behind the cathode active surface so that the cathode active surface is deformed or deflected towards the anode surface. As a result, as shown in FIG. 2, a state in which the anode and the cathode are in contact with each other through the ion exchange membrane interposed therebetween, is realized.

The leaf springs had a shape as shown in FIG. 3. The modulus of elasticity is preferably from 50 to 50,000 g/mm (1,000 g/mm in the Example). The resilient member for pressing the cathode plate is not restricted to leaf springs. For example, coil springs having the modulas of elasticity mentioned above as shown in FIG. 4 may be employed. With respect to the number of springs, more uniform pressing pressure can be accomplished as the number increases. However, at the same time, the assembling tends to be complex. Therefore, the number of springs is preferably from 2 to 100 (8 in the Example).

Figure 5:
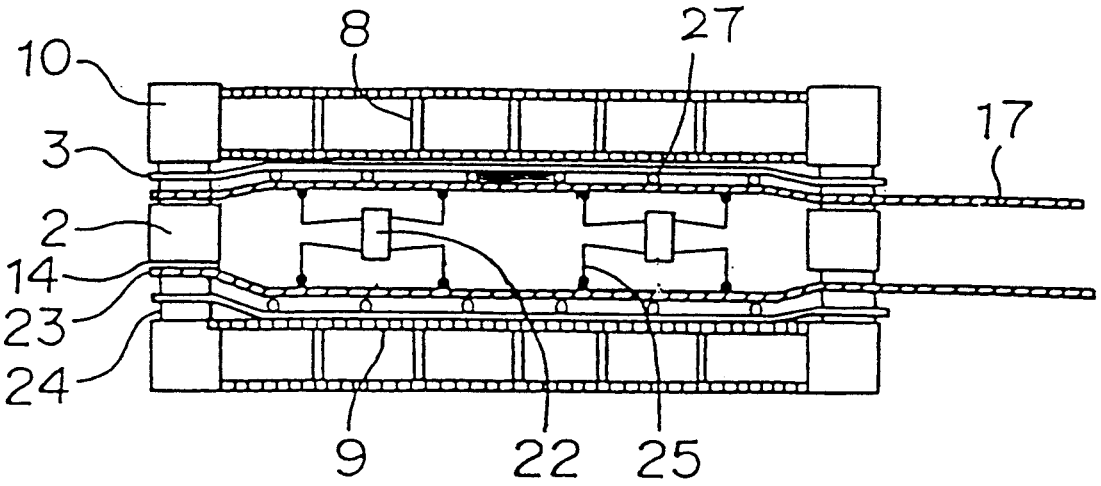
FIG. 5 is a partially cross-sectional view of the electrolytic cell of the another embodiment of the present invention after being assembled.

Between the cathode plate and the membrane at least one (preferably 3–15) spacer 27 may be interposed to control the distance between the electrodes to a certain uniform level as shown in FIG. 5. Such spacer has a thickness of preferably less than 2.0 mm, more preferably 0.5–1.5 mm and its shape is a net, a string or the like. The spacer is preferably made of non electro-conductive material having a bigger rigidity than the ion exchange membrane. The example of the material is a fluoropolymer, polypropylene, EPPM or the like.

Sodium chloride aqueous solution was electrolyzed by using the electrolytic cell described above wherein four ion exchange membranes were used, each membrane being substantially in contact with the anode and the cathode. The anode and cathode compartment frames in the cell were arranged alternately and clamped by means of end plates and tie rods provided at both ends.

While supplying an aqueous sodium chloride solution having a concentration of 300 g/l to the anode compartments and deionized water to the cathode compartments, electrolysis was conducted at 30 A/dm$^2$ at 90° C. The hydraulic pressure of the cathode compartment was kept higher than that of the anode compartment by from 50 to 1,500 mm $H_2O$. The aqueous solution of sodium hydroxide thereby formed had a concentration of 32 wt %, the current efficiency was 95.7%, and the cell voltage was 3.00V. The operation was continued for 300 days, during which the operation was stopped 6 times, and the electrolyzing performance was substantially the same as the initial stage of the operation. Thereafter, the operation was stopped and the electrolytic cell was disassembled for inspection, whereby no abnormality such as corrosion of the base material of the cathode plate or peeling of the coated material, was observed. Further, in the cation exchange membranes, no abnormality such as rapture or color change was observed.

ANOTHER EXAMPLE

The same anode compartment assembly and membranes as used in the above first Example, were employed, but with respect to the cathode assembly, no spring was used, and the cathode was secured to the cathode supporting member, whereby the average distance between the anode and cathode was about 3 mm.

With this cell, electrolysis was conducted. As the electrolyzing conditions, the same conditions as used in the above Example were employed. As a result, the current efficiency was 95.5%, and the cell voltage was 3.15V.

FURTHER EXAMPLE

The same anode compartment assembly, ion exchange membrane and the cathode compartment assembly as used in the First Example, except that sixteen leaf springs having elasticity of 500 g/mm were used and each six rod-like spacers made of PTFE having 1.0 mm in diameter and 1.3 m in length were interposed between the cathode plate and the membrane as shown in FIG. 5. The average distance between the anode and the cathode was about 1.0 mm.

With this cell, electrolysis was conducted. As the electrolyzing conditions, the same conditions as used in the above Example were employed. As a result, the current efficiency was 95.5% and the cell voltage was 3.04V.

After 150 days of the operation, the cell was disassembled for inspection and no abnormality was observed.

What is claimed is:

1. A monopolar ion exchange membrane electrolytic cell assembly, comprising:

at least one electrolytic cell comprising anode compartment frame opposed to a cathode compartment frame with an ion exchange membrane interposed therebetween, the anode and cathode compartment frames each having a feeding and discharging system for an electrolyte and a discharging system for generated gas;

an anode made of a foraminous first plate fixed to the anode compartment frame so that the first plate is close to or in contact with the ion exchange membrane;

means for supplying electricity to the foraminous first plate, comprising power supply rods and/or power supply ribs from a power source located outside the cell; and a cathode comprising a foraminous second plate and an electricity conducting frame means, wherein the frame means is integrally and electrically connected to the foraminous second plate and encloses the second foraminous plate, for conducting electricity to and from the foraminous second plate;

wherein the second plate is pressed by a resilient member means for pressing. from the side opposite to the side facing the ion exchange membrane, whereby the flexible cathode plate is deflected so that the cathode is close to or in contact with the ion exchange membrane; and at least one spacer is interposed between the second plate and the ion exchange membrane for maintaining a uniform distance separation between the second plate and the ion exchange membrane.

2. The electrolytic cell assembly according to claim 1, wherein at least one of the anode compartment frame and the cathode compartment frame is made of a hollow pipe having a tetragonal cross section provided with an inlet nozzle and outlet for the electrolyte and an outlet nozzle for the generated gas.

3. The electrolytic cell assembly according to claim 1, wherein the periphery of the flexible foraminous cathode plate is flattened to form a non-foraminous flat peripheral portion, and said flat peripheral portion is clamped as interposed between the ion exchange membrane and the cathode compartment frame to seal off the catholyte and generated gas.

4. The electrolytic cell assembly according to claim 1, wherein the cathode further comprises a coating of a cathode active substance on a surface of the second foraminous plate, wherein the second foraminous plate comprises a metal selected from the group consisting of cast iron, nickel, copper, zinc and alloys composed mainly thereof.

5. The electrolytic cell assembly according to claim 1, wherein the anode comprises a coating of an anode active substance on the surface of a valve metal substrate.

6. The electrolytic cell assembly according to claim 1, wherein a length in the direction of electric current of the conductive surface of the electrolytic cell assembly is at least 70 cm.

7. The electrolytic cell assembly according to claim 1, wherein the pressure of the resilient member means for pressing the flexible foraminous cathode plate is not higher than 500 g/cm$^2$ of the apparent area of the cathode.

8. The electrolytic cell assembly according to claim 1, wherein the resilient member means comprises a leaf spring or a coil spring.

9. The electrolytic cell assembly according to claim 1, wherein the spacer has a thickness of less than 2.0 mm.

10. The electrolytic cell assembly according to claim 1, wherein the ion exchange membrane has on at least one side thereof a hydrophilic porous layer having no electrode activity.

11. The electrolytic cell assembly according to claim 1, further comprising producing means for producing an alkali metal hydroxide and chlorine by electrolyzing an aqueous alkali metal chrolide solution.

12. A cell according to claim 1, wherein:

the second foraminous plate material is flexible and has electric resistance at 20° C. of not higher than 10 $\mu\Omega$.cm.

13. A cell assembly according to claim 1, further comprising:

at least a second said at least one electrolytic cell.

14. The electrolytic cell assembly according to claim 1, wherein said spacer is formed of insulating material.

15. The electrolytic cell assembly according to claim 14, wherein said insulating material is a fluoropolymer or polypropylene.

16. The electrolytic cell assembly according to claim 1, wherein said spacer has a rigidity greater than that of the ion exchange membrane.

17. A monopolar ion exchange membrane electrolytic cell assembly, comprising:

a cathode comprising a flexible conducting foraminous plate and a conducting frame, said plate having peripheral edges integrally and electrically connected to said conducting frame, said conducting frame enclosing a second foraminous sheet, whereby electricity is conducted between the second foraminous sheet and the conducting frame; and an insulating resilient member means for pressing against a first side of said foraminous plate.

18. A cell according to claim 17, further comprising:

an ion exchange member interposed adjacent a second side of said foraminous plate.

19. A cell according to claim 17, further comprising:

an anode compartment frame opposed to a cathode compartment frame with an ion exchange membrane interposed therebetween, the anode and cathode compartment frames each having a feeding and discharging system for an electrolyte and a discharging system for generated gas, wherein the cathode is fixed to the cathode compartment frame.

20. A cell according to claim 19, wherein:

the conducting frame of the cathode comprises electrical connection means for connecting the cathode to a current supply means for supplying current to the cathode, said electrical connection means comprising a portion of the conducting frame of the cathode which extends beyond the dimensions of the cathode and anode compartment frames.

* * * * *